US007044200B2

(12) United States Patent
Gupte et al.

(10) Patent No.: US 7,044,200 B2
(45) Date of Patent: May 16, 2006

(54) TWO-PHASE REFRIGERANT DISTRIBUTION SYSTEM FOR MULTIPLE PASS EVAPORATOR COILS

(75) Inventors: Neelkanth Shridhar Gupte, Granger, IN (US); Steven J. Spencer, Rochester, NY (US)

(73) Assignee: Carrier Corporation, Farmington, CT (US)

( * ) Notice: Subject to any disclaimer, the term of this patent is extended or adjusted under 35 U.S.C. 154(b) by 155 days.

(21) Appl. No.: 10/788,134

(22) Filed: Feb. 26, 2004

(65) Prior Publication Data

US 2005/0189090 A1 Sep. 1, 2005

(51) Int. Cl.
*F28F 27/02* (2006.01)

(52) U.S. Cl. ..... 165/103; 165/108

(58) Field of Classification Search ..... 165/103, 165/108, 100, 139, 144, 176; 62/519, 525–528
See application file for complete search history.

(56) References Cited

U.S. PATENT DOCUMENTS 3,450,197 A * 6/1969 Fieni ..... 165/142
5,752,566 A * 5/1998 Liu et al. ..... 165/110
6,341,648 B1 * 1/2002 Fukuoka et al. ..... 165/144
2003/0127217 A1 * 7/2003 Joboji et al. ..... 165/153

FOREIGN PATENT DOCUMENTS

JP 54-26557 * 7/1977 ..... 165/103

* cited by examiner

*Primary Examiner*—Teresa J. Walberg
(74) *Attorney, Agent, or Firm*—Wall Marjama & Bilinski LLP

(57) ABSTRACT

A multiple pass, parallel tube heat exchanger with a collection header extending along the length of each of a first and second pass, is provided with a bypass tube which fluidly interconnects the downstream end of the collection header to a midpoint thereof, near the end of the first pass tubes and the beginning of the second pass tubes so as to enhance the flow distribution of two-phase refrigerant from the collection header to the second pass tubes. The distribution flow is further enhanced by the insertion of an eductor nozzle within the collection header, and with the inlet of the eductor nozzle being supplied by refrigerant flow from the condenser to thereby provide a motive flow of two-phase refrigerant in the loop which includes the latter half of the collection header and the bypass tubes.

4 Claims, 1 Drawing Sheet

TWO-PHASE REFRIGERANT DISTRIBUTION SYSTEM FOR MULTIPLE PASS EVAPORATOR COILS

BACKGROUND OF THE INVENTION

This invention relates generally to heat exchangers and, more particularly, to two-phase refrigerant distribution for multipass parallel tube coils. Two-phase flow of refrigerant needs to be uniformly redistributed between passes into several parallel tubes. The refrigerant from the first pass generally exits into a collection header after which it then passes along the header to the entrance area of the second pass. Partly, because of the dissipation of heat and pressure in the first pass, significant mal-distribution of liquid refrigerant tends to occur in the second and subsequent passes.

The above described phenomenon is particularly true in the case of parallel flow heat exchangers that use flat tubes with microchannels, which are widely used in automotive air conditioning as condensers. The tubes are laid in a horizontal direction and are attached to common headers. When operating as a condenser, the heat exchanger performs satisfactorily, but when the heat exchanger is used as an evaporator, the mal-distribution of two-phase refrigerant occurs as described above.

SUMMARY OF THE INVENTION

Briefly, in accordance with one aspect of the invention, a bypass tube is provided to interconnect the collection header from the end of the second pass to the beginning of the second pass. This forms a recirculation loop in the area of the second pass to provide uniform distribution instead of allowing the flow separation of liquid and vapor that would otherwise occur.

In accordance with another aspect of the invention, an inductor nozzle is placed in the collection header at the beginning of the second pass. A source of two-phase refrigerant is interconnected to drive the inductor nozzle and to thereby assist in the flow within the bypass tube and along the collection header in the vicinity of the second pass tubes, thereby assisting in the improved redistribution of refrigerant flow into the second pass tubes.

In the drawings as hereinafter described, there are two embodiments depicted; however, various other modifications and alternate constructions can be made thereto without departing from the true spirit and scope of the invention.

DESCRIPTION OF THE PREFERRED EMBODIMENT

Figure 1:
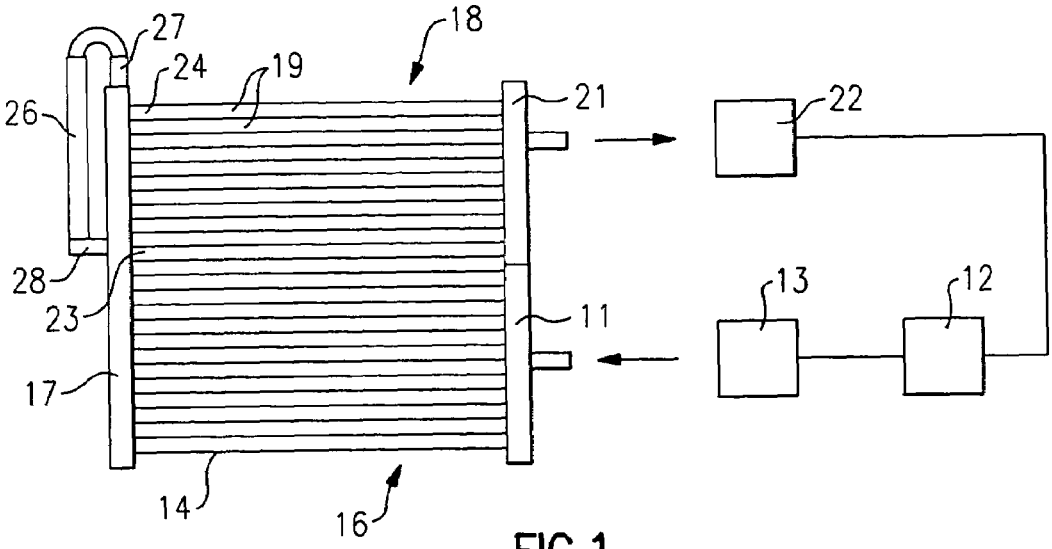
FIG. 1 is a schematic illustration of one embodiment of the present invention.

Referring now to FIG. 1, a heat exchanger is shown to include a first header 11 which receives a flow of two-phase refrigerant from a condenser 12 by way of an expansion device 13 in a conventional manner.

Fluidly connected to and extending orthogonally from the first header 11 as a plurality of parallel tubes 14 that carry the refrigerant flow in a first pass 16 of the heat exchanger. Fluidly connected at the other end of the tubes 14 is a second header 17 commonly referred to as the collection header.

The collection header 17 extends not only along the full length of the first pass tubes but also along the full length of a second pass 18 comprising the parallel tubes 19 for conducting the flow of refrigerant from the second header to a third header 21 which then passes the refrigerant vapor to a compressor 22. From the compressor, the high-pressure vapor is then passed to the condenser 12 to complete the circuit.

Referring again to the heat exchanger second pass 18, the parallel tubes 19 include a first tube 23 nearest the first pass 16 and a last tube 24 furthest from the first pass 16.

In order to improve the uniform distribution of two-phase refrigerant flow to the tubes 19 of the second pass 18, a bypass tube 26, with it return bend 30, is provided with its one end 27 fluidly connected to the end of the second header 17 near the last tube 24, and with its other end 28 fluidly interconnected at an intermediate point in the second header 17 near the second pass first tube 23. The flow of refrigerant through the bypass tube 16 and the latter half of the second header 17 causes an improved uniform flow to the tubes 19 and prevents the flow separation of liquid and vapor, and their resulting flooding in some tubes and starving in others, that might otherwise result.

Figure 2:
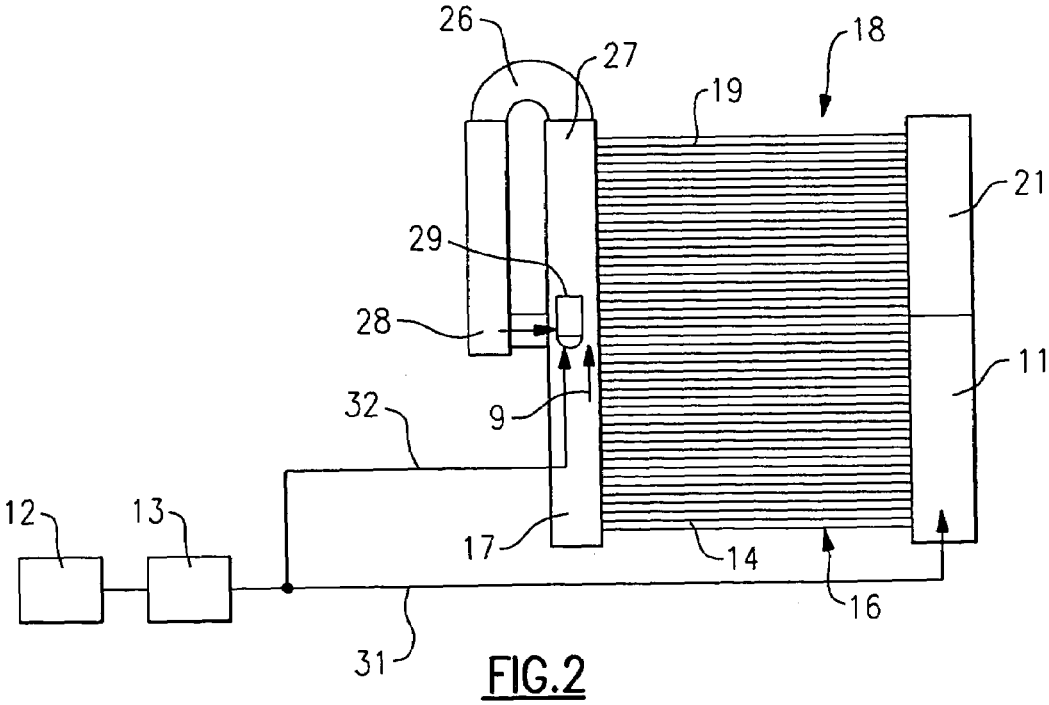
FIG. 2 is a schematic illustration of an alternate embodiment of the present invention.

Referring now to FIG. 2, the uniformity of refrigerant distribution to tubes 19 of the second pass 18 may be furthered enhanced by boosting the flow of refrigerant in the second half of the second header 19 and through the bypass tube 26. This can be accomplished by the introduction of a eductor nozzle 29 near the midpoint of the second header 17. The placement of the eductor nozzle 29 is preferably near the first tube 23 of the second pass 18, and near the point where the bypass tube other end 28 is fluidly connected to the second header 17.

In order to drive the eductor nozzle 29, the refrigerant flow from the expansion device 13 is split into with a primary portion passing along lines 31 to the first header 11, and with another portion passing along line 32 to the inlet of the eductor nozzle 29. The motive flow from the eductor nozzle 29 assists in the recirculation of two-phase flow in the loop formed by the outer half of the header 17 and the bypass tubes 26 to improve the uniform distribution of refrigerant to the tubes 19 in the second pass 18.

While the present invention has been particularly shown and described with reference to a preferred and alternate embodiments as illustrated in the drawings, it will be understood by one skilled in the art that various changes in detail may be effected therein without departing from the true spirit and scope of the invention as defined by the claims.

We claim:

1. A heat exchanger of the type having a plurality of tubes in each of a plurality of passes, comprising:

a first header for receiving from a source, two-phase refrigerant flow and for diverting the flow to be distributed amongst a plurality of first pass tubes being disposed substantially orthogonal to said first header and substantially parallel to each other;

a second header disposed substantially orthogonal to said plurality of first pass tubes and fluidly connected thereto for receiving the two-phase refrigerant flow from said plurality of first phase tubes and for conducting the flow of refrigerant to a plurality of second pass tubes being disposed substantially orthogonal to said second header and being disposed substantially parallel to each other;

a third header being disposed substantially orthogonal to said plurality of second pass tubes and being fluidly connected thereto for receiving refrigerant flow therefrom; and a bypass tube fluidly connected at its one end to a downstream end of said second header near a last second pass tube farthest from said first pass tubes and at its other end to an intermediate point of said second header adjacent a first second pass tube nearest to said first pass tubes, said bypass tube being capable of conducting the flow of refrigerant from said second header downstream end to said second header intermediate point and thereby aid in the uniform distribution of refrigerant flow to said second pass tubes.

2. A heat exchanger as set forth in claim 1 and including an eductor nozzle disposed in said second header near said intermediate point for receiving a booster flow of refrigerant in one end thereof and discharging a flow from the other end thereof in a direction substantially orthogonal to said second pass tubes.

3. A heat exchanger as set forth in claim 2 wherein said booster flow originates from the same source of refrigerant as that passing to said first header.

4. A heat exchanger as set forth in claim 3 wherein said source is a condenser.

* * * * *